US006086329A

United States Patent [19]

Tomita et al.

[11] Patent Number: 6,086,329

[45] Date of Patent: Jul. 11, 2000

[54] SEAL PLATE FOR A GAS TURBINE MOVING BLADE

[75] Inventors: Yasuoki Tomita; Hiroki Fukuno; Eisaku Ito, all of Takasago, Japan

[73] Assignee: Mitsubishi Heavy Industries, Ltd., Tokyo, Japan

[21] Appl. No.: 09/038,070

[22] Filed: Mar. 11, 1998

[30] Foreign Application Priority Data

Mar. 12, 1997 [JP] Japan ..... 9-057535

[51] Int. Cl.[7] ..... F01D 5/22; F01D 11/00

[52] U.S. Cl. ..... 416/193.004; 416/248; 277/634; 277/643; 277/650

[58] Field of Search ..... 416/193 A, 190, 416/191, 248; 415/115, 135, 138, 139; 277/634, 643, 650

[56] References Cited

U.S. PATENT DOCUMENTS

| | | | |
|---|---|---|---|
| 1,825,239 | 9/1931 | Meyer . | |
| 2,912,223 | 11/1959 | Hull, Jr. | 416/193 A |
| 3,551,068 | 12/1970 | Scalzo et al. | 416/193 A |
| 3,728,041 | 4/1973 | Bertelson | 415/139 |
| 3,801,220 | 4/1974 | Beckershoff | 416/193 A |
| 4,336,943 | 6/1982 | Chaplin | 277/643 |
| 5,338,152 | 8/1994 | Feldmann | 415/139 |
| 5,865,600 | 2/1999 | Mori et al. | 415/135 |

FOREIGN PATENT DOCUMENTS

| | | |
|---|---|---|
| 2 127 104 | 4/1984 | Germany . |
| 342795 | 1/1963 | Switzerland . |

*Primary Examiner*—Christopher Verdier
*Attorney, Agent, or Firm*—Alston & Bird LLP

[57] ABSTRACT

A seal plate at the platform portion of a gas turbine moving blade. The seal plate is inserted in a gap between the adjacent platforms at each end portion of a seal pin to prevent air from leaking to the outside. A groove is provided at each of four corners of the end portion of platform of the moving blade, and the seal plate is inserted to cover the gap so as to extend the end portions of the adjacent platforms, by which the gap between the platforms is blocked. A seal pin and end seal pins are inserted between the platforms to seal this portion. However, there is a gap at the end portions, so that cooling air leaks from the lower part of platform. Since the seal plate is inserted in the groove to block the gap, the sealing property is increased.

7 Claims, 6 Drawing Sheets

SEAL PLATE FOR A GAS TURBINE MOVING BLADE

FIELD OF THE INVENTION AND RELATED ART STATEMENT

The present invention relates to a seal plate for a gas turbine moving blade, which prevents the leakage of cooling air introduced into a gas turbine moving blade.

FIG. 6 is a perspective view showing a seal construction at the platform portion of a conventional gas turbine moving blade, and FIG. 7 is a view in the direction of arrow C—C in FIG. 6. In these figures, reference numeral 1 denotes a moving blade, 1' denotes an adjacent moving blade, 2 denotes a platform for the moving blade 1, 2' denotes a platform for the adjacent moving blade 1', 3 denotes a shank portion provided at the lower part of the platform 2, 4 denotes a seal pin disposed between the blades, 5 denotes an end seal pin. These seal pins 4 and 5, which are inserted in a gap between the platforms 2 and 2' for the moving blades 1 and 1' arranged circumferentially at the blade root portion as shown in FIG. 6, provides a seal between blades to prevent cooling air introduced into the moving blade 1 from the shank portion 3 at the lower part of the platform 2 from leaking to the high-temperature gas passage through the gap between the adjacent platforms 2, 2'.

FIG. 8 is a sectional view taken along the line D—D of FIG. 7. The platform 2 is provided with a groove 6. The seal pin 4 engages with this groove 6 to provide a seal between the platforms 2 and 2'. The gap d between the platforms 2 and 2' is about 1.5 to 2.0 mm. To seal this gap d, the seal pin 4 with a diameter of about 2 to 3 mm is provided so as to extend longitudinally.

As shown in FIG. 7, at each end of the platform 2, the end seal pin 5 is provided in an inclined manner so that one end thereof is in contact with the end of the seal pin 4. The end seal pin 5 seals the lower part between the platforms 2 and 2'. The seal pin 4 engages with the groove 6 as shown in FIG. 8. When the seal pin 4 is pushed upward by a centrifugal force as indicated by an arrow mark, the seal pin 4 comes into contact with a taper portion 6*a* of the groove 6 to block the gap d, so that air is difficult to leak.

FIG. 9 is a view in the direction of arrow E—E in FIG. 7, showing end portions 2*a* and 2*a'* of the adjacent platforms 2 and 2'. A gap 7 is present between the adjacent end portions 2*a* and 2*a'*. The seal pins 4 and 5 do not seal this portion, so that part of cooling air introduced into the moving blade 1 from the shank portion 3 passes through this gap 7 and leaks as indicated by 8*a* and 8*b* in FIG. 7.

By the above-described configuration, cooling air fed from a turbine rotor (not shown) passes through a turbine disk, is introduced to the shank portion 3 at the lower part of the platform 2, and introduced to a cooling air passage (not shown) in the moving blade 1. As described above, the seal pins 4 and 5 provides a seal between the platforms 2 and 2' to prevent the cooling air from leaking to the high-temperature combustion gas passage.

The seal between the platforms 2 and 2' for the aforementioned conventional gas turbine moving blade is provided by the seal pins 4 and 5. However, the end portions 2*a* and 2*b* of the platform 2 has a gap 7 between the adjacent platforms 2 and 2' as shown in FIG. 9, so that the sealing property is insufficient. Therefore, part of cooling air introduced to the lower part of the platform 2 leaks to the outside through the gap 7 as indicated by 8*a* and 8*b* in FIG. 7, escaping to the high-temperature combustion gas passage, which adversely affects the performance of the gas turbine.

OBJECT AND SUMMARY OF THE INVENTION

Accordingly, a first object of the present invention is to provide a seal plate for a gas turbine moving blade, which prevents the leakage of cooling air from a gap at the end portion of a platform to increase the sealing property, while the leakage of cooling air to the outside from between the adjacent platforms is prevented by seal pins.

Further, a second object of the present invention is to provide a seal plate for a gas turbine moving blade, which has a shape such that the seal plate can be mounted easily between the adjacent platforms.

To solve the above first and second objects, the present invention provides the following means of (1) and (2).

(1) In a gas turbine moving blade in which seal pins are inserted between platforms for a plurality of moving blades arranged circumferentially around a rotating shaft to prevent cooling air from leaking from the lower part between the adjacent platforms, grooves extending substantially in the rotating shaft direction are formed at four corners of a flange portion extending longitudinally in the rotating shaft direction of the platform, and a seal plate is inserted in the grooves so as to extend between the adjacent platforms to block a gap between the platforms.

(2) In the above item (1), the seal plate, made of a V-shaped elastic material, is spread by the spring force thereof after being inserted in the groove, by which the seal plate is fixed by being pressed against the inside faces of the groove.

In the above item (1) of the present invention, since the gap between the end portions of the adjacent platforms is blocked by the seal plate, the cooling air introduced into the moving blade from the lower part of the platform does not leak through this gap, so that a seal can be provided surely together with the seal pins existing conventionally. Therefore, the sealing property is increased as compared with the conventional moving blade without the seal plate.

In the above item (2) of the present invention, the seal plate is made of a V-shaped elastic material, and can be inserted easily in the groove by pushing and shrinking the V shape open portion. After insertion, the seal plate spreads in the groove so that the shape thereof is returned to the original V shape by the restoring force of the elastic material, and is fixed by being pressed against the upper and lower faces of the groove. When being removed for maintenance, the seal plate can be pulled out of the groove easily by gripping and shrinking the V shape open portion.

According to the above item (1) of the present invention, in a gas turbine moving blade in which seal pins are inserted between platforms for a plurality of moving blades arranged circumferentially around a rotating shaft to prevent cooling air from leaking from the lower part between the adjacent platforms, grooves extending substantially in the rotating shaft direction are formed at four corners of a flange portion extending longitudinally in the rotating shaft direction of the platform, and a seal plate is inserted in the grooves so as to extend between the adjacent platforms to block a gap between the platforms. Therefore, since the gap between the end portions of the adjacent platforms is blocked by the seal plate, this portion is sealed, and the leakage of cooling air is eliminated, whereby the sealing property of gas turbine is increased and the turbine performance is improved.

According to the above item (2), the seal plate, made of a V-shaped elastic material, is spread by the spring force thereof after being inserted in the groove, by which the seal plate is fixed by being pressed against the inside faces of the groove. Therefore, the seal plate can be inserted in the groove easily, and can be fixed in the groove simply by the spring force. Moreover, when maintenance is performed, the seal plate can be removed easily.

DETAILED DESCRIPTION OF PREFERRED EMBODIMENTS

Figure 1:
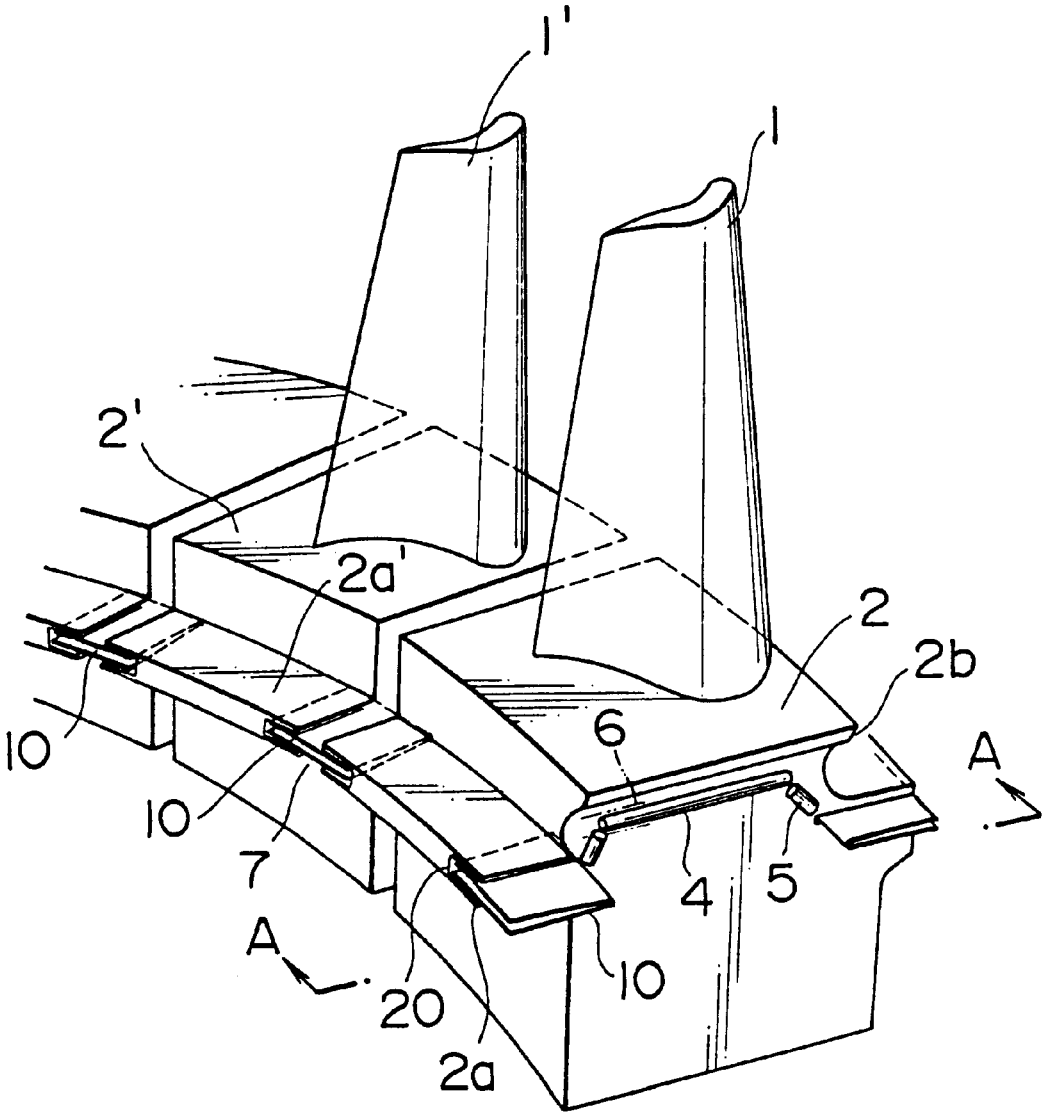
FIG. 1 is a perspective view showing an installation state of a seal plate for a gas turbine moving blade in accordance with one embodiment of the present invention.
Figure 2:
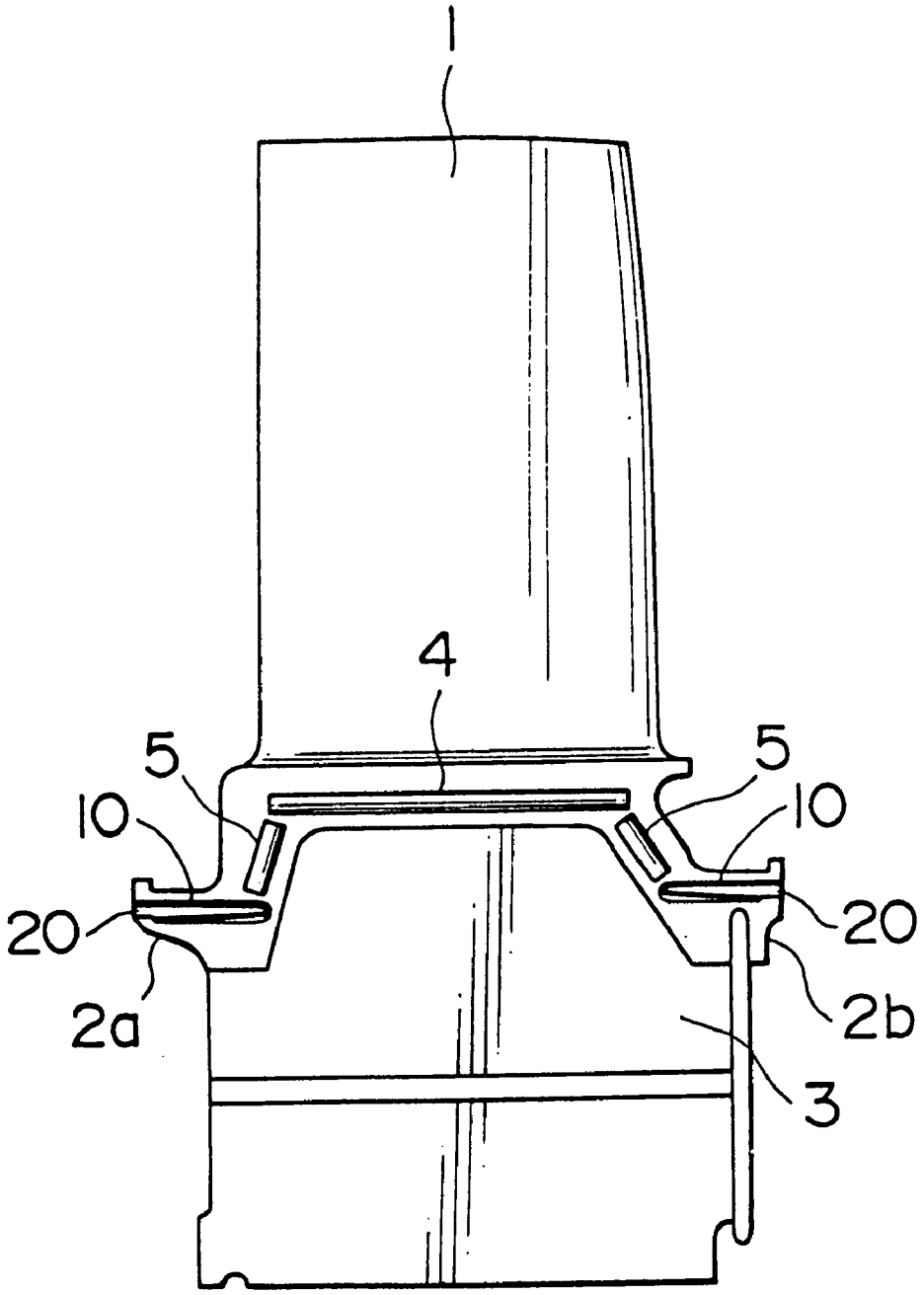
FIG. 2 is a view in the direction of arrow A—A in FIG. 1.

An embodiment of the present invention will be described in detail with reference to the accompanying drawings. FIG. 1 is a perspective view showing an arrangement of seal plates for a gas turbine moving blade in accordance with the present invention, and FIG. 2 is a view in the direction of arrow A—A of FIG. 1. In these figures, the elements of reference numerals 1 to 7 have the same function as that of the conventional ones, the detailed explanation thereof is omitted in the description of this embodiment.

The characteristic portion of the present invention is a seal plate denoted by reference numeral 10 and a groove 20 for accommodating the seal plate 10. This characteristic portion will be described in detail below.

In FIGS. 1 and 2, a seal pin 4 is provided in a groove 6 in a platform 2 of a moving blade 1 like the conventional moving blade, and end seal pins 5 are provided at both ends. The lower part of the platform 2 is sealed and a seal is provided between the platforms 2 and 2' by these seal pins 4 and 5.

At both ends 2*a* and 2*b* of the platform 2, a groove 20 perpendicular to a gap 7 is formed so as extend from the platform 2 to the adjacent platform 2'. The depth of the groove 20 reaches the region including the lower end of the end seal pin 5 as shown in FIG. 2.

The groove 20 is formed in both of the platforms 2 and 2', and a seal plate 10, described later, is inserted in the groove 20. The seal plate 10 is fixed in the groove 20 by the spring force thereof. Therefore, the space of the gap 7 is completely separated into the upper part and lower part by this seal plate 10, so that the communication between the space portion of a shank portion 3 and the outside through this gap 7 is completely cut off.

Figure 3:
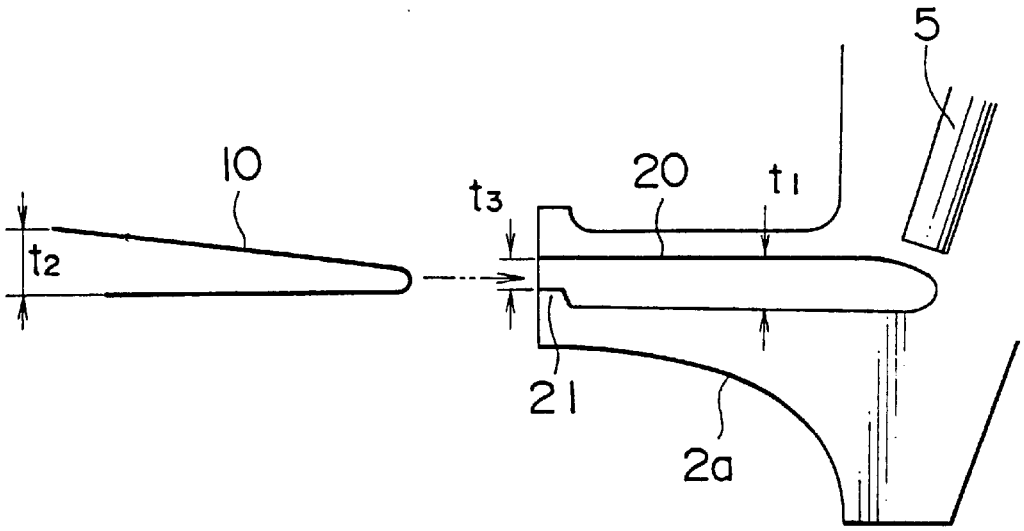
FIG. 3 is an enlarged view of the end portion of a platform, also showing a seal plate.

FIG. 3 is an enlarged detailed view of the end portion 2*a* of the platform 2. The groove 20 extends in the longitudinal direction to reach the region including the lower part of the end seal pin 5 or the region beyond it. The vertical width $t_1$ of the groove 20 is about 2 mm, and a protrusion-like claw 21 is provided at the inlet portion of the groove 20. The groove 20 configured as described above is formed at each of the end portions 2*a* and 2*b*, and a seal plate 10 as shown in the figure is inserted in the groove 20.

The seal plate 10 is formed into a V (clip) shape, and the lower end portion of V-shaped seal plate 10 is formed so short as to be capable of engaging with the claw 21 in the groove 20 as shown in FIG. 3. The seal plate 10 is made of an elastic material with a thickness of about 0.3 mm which can withstand a temperature of 500 to 600° C. such as hastelloy. The dimension of $t_2$ of the V shape open portion is set to a dimension slightly larger than the width $t_1$ of the groove 20. Therefore, the seal plate 10 is inserted in the groove 20 by shrinking the V shape open portion to a dimension smaller than the opening dimension $t_3$ of the groove 20. After insertion, the shape of the seal plate 10 is restored by the spring force and the seal plate 10 is pressed against the upper and lower faces of the groove 20, whereby the seal plate 10 is fixed.

Figure 4:
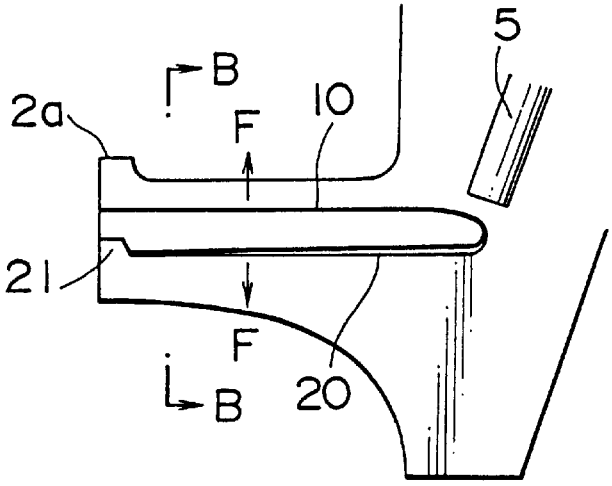
FIG. 4 is an enlarged view of the end portion of a platform in FIG. 1, showing a state in which a seal plate is inserted.
Figure 5:
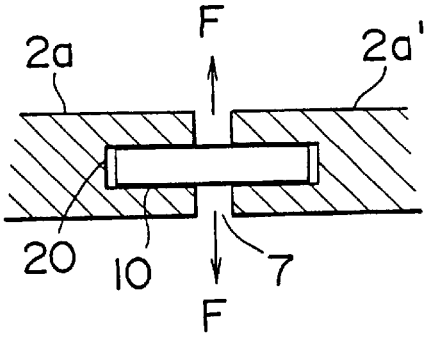
FIG. 5 is a sectional view taken along the line B—B of FIG. 4.
Figure 6:
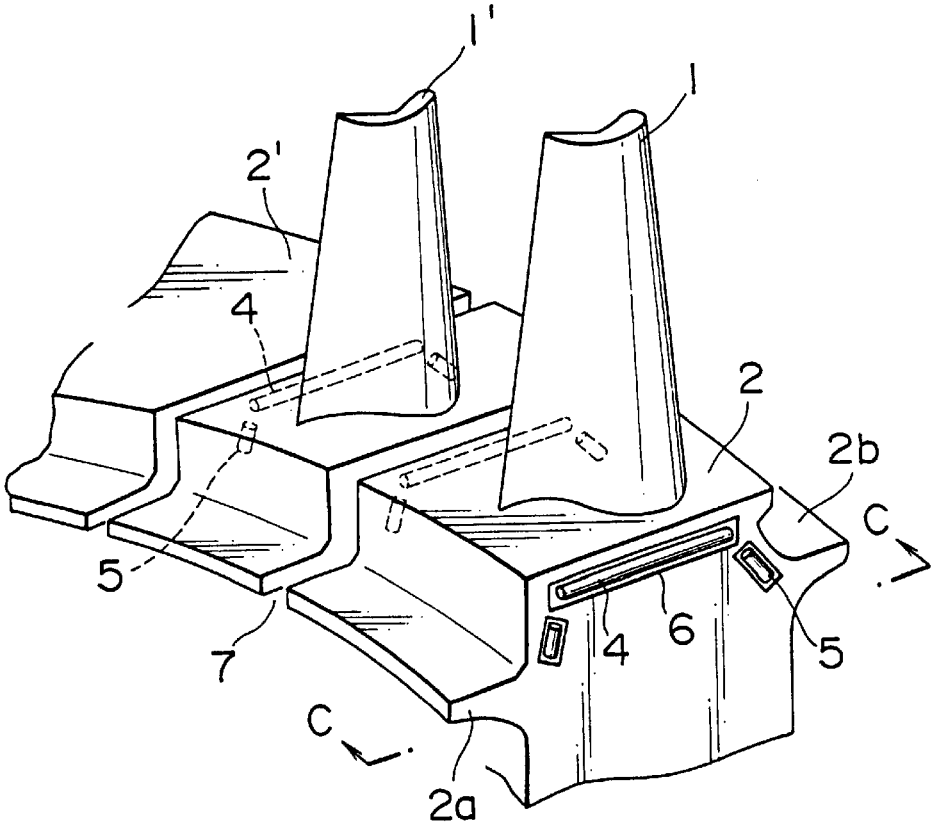
FIG. 6 (PRIOR ART)
FIG. 6 is a perspective view showing a sealing state of a platform portion for a conventional gas turbine moving blade.
Figure 7:
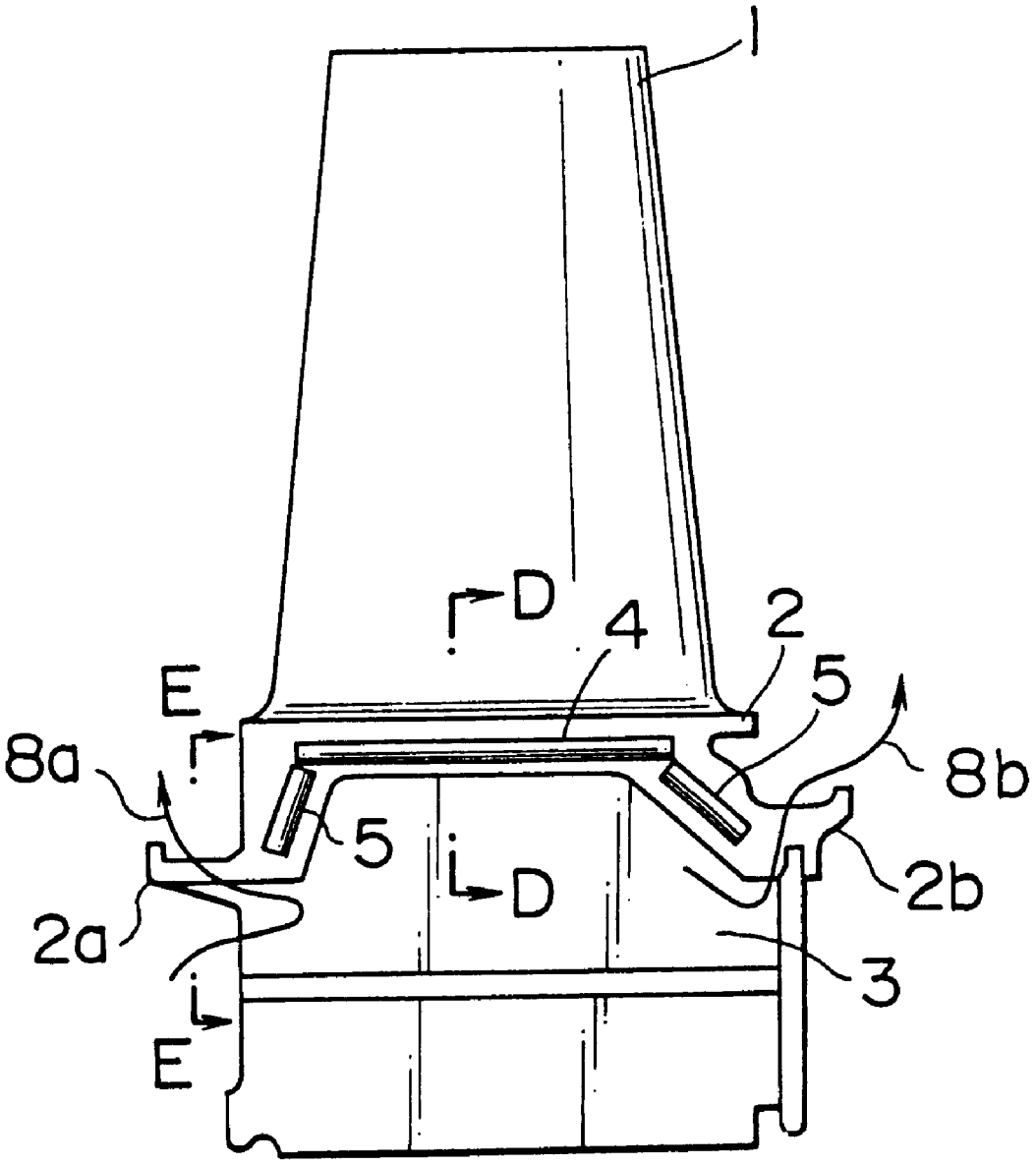
FIG. 7 (PRIOR ART)
FIG. 7 is a view in the direction of arrow C—C in FIG. 6.
Figure 8:
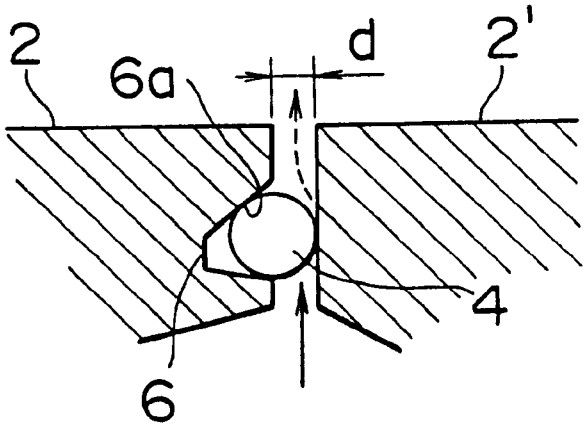
FIG. 8 (PRIOR ART)
FIG. 8 is a sectional view taken along the line D—D of FIG. 7.
Figure 9:
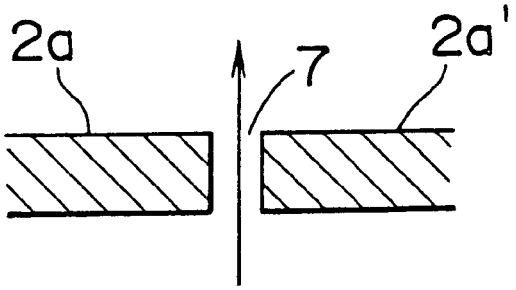
FIG. 9 (PRIOR ART)
FIG. 9 is a view in the direction of arrow E—E in FIG. 7.

FIG. 4 shows a state in which the seal plate 10 is inserted in the groove 20 from the state shown in FIG. 3 as described above, and the shape of the seal plate 10 is restored by the spring force F and the lower end thereof engages with the claw 21, by which the seal plate 10 is completely fixed. FIG. 5 is a sectional view taken along the line B—B of FIG. 4. The seal plate 10, which extends to the adjacent end portions 2*a* and 2*a'*, is inserted in the groove 20, completely blocking the gap 7.

As shown in these figures, the groove 20 has a total width of about 10 mm extending to both of the adjacent platform end portions 2*a* and 2*a'*, and the seal plate 10 having a width slightly smaller than 10 mm is inserted to block the gap 7 completely at the upper and lower parts, by which this portion is sealed. Therefore, the seal plate 10, in concert with the seal pin 4 and the end seal pins 5, can provide a complete seal between the adjacent platforms 2 and 2', so that cooling air is prevented from leaking to the high-temperature combustion gas passage from this portion. When maintenance is performed, the seal plate 10 can be pulled out of the groove 20 easily by gripping and shrinking the V shape open portion.

We claim:

1. A rotating blade row for a gas turbine, comprising:

a plurality of moving blades adapted to be adjacently arranged around a circumference disposed about a longitudinal axis of the gas turbine, each moving blade including a platform which has opposite sides that confront the corresponding platforms of adjacent moving blades, each platform including a forward flange portion and an aft flange portion, each flange portion defining two opposite corners spaced from corresponding corners of flange portions of adjacent moving blades;

seal pins inserted between adjacent platforms of the moving blades to prevent cooling air from leaking from lower parts of the moving blades between the adjacent platforms, the seal pins including forward ends proximate forward edges of the platforms and aft ends proximate aft edges of the platforms;

grooves formed at the four corners of the flange portions of each platform, each groove extending substantially longitudinally and circumferentially, the grooves at the forward edges of the platforms extending longitudinally such that the grooves overlap the forward ends of the seal pins, and the grooves at the aft edges of the platforms extending longitudinally such that the grooves overlap the aft ends of the seal pins; and a seal member inserted in each pair of adjacent grooves in the forward and aft flange portions of the moving blades so as to extend across gaps between the adjacent comers thereof to seal the gaps between the platforms, the seal members at the forward and aft edges of the platforms being disposed in the grooves so as to respectively overlap the forward and aft ends of the seal pins.

2. The rotating blade row of claim 1 wherein the seal members comprise plates each having opposite end portions inserted into the opposing grooves of adjacent moving blades.

3. The rotating blade row of claim 1 wherein the seal members comprise seal plates, each seal plate having upper and lower portions joined to form a generally V-shaped cross-section of the seal plate, the seal plates being formed of an elastic material and adapted to urge the upper and lower portions against inner surfaces of the grooves for facilitating retaining the seal plates therein.

4. The rotating blade row of claim 3 wherein one of the upper and lower portions of each seal plate is shorter in the longitudinal direction than the other portion and engages protrusions formed on the corresponding inner surfaces of the grooves to facilitate retaining the seal plates in the grooves.

5. A moving blade for a gas turbine of the type including a plurality of said moving blades adjacently arranged around a circumference disposed about a longitudinal axis of the gas turbine, comprising:

a blade portion;

a platform attached to an inner end of the blade portion, the platform including two opposite sides adapted to confront the corresponding platforms of adjacent moving blades, the platform including a forward flange portion and an aft flange portion, each flange portion defining two opposite corners adapted to confront corresponding corners of flange portions of adjacent moving blades;

a groove formed at each corner of the flange portions of the platform, each groove extending substantially in a longitudinal direction and in a circumferential direction, each groove having opposing inner surfaces, one of said inner surfaces defining a protrusion thereon extending toward the opposite inner surface; and a seal member which has one end portion inserted in each groove and an opposite end portion adapted to be inserted in the opposing groove of an adjacent moving blade so as to extend therebetween to seal gaps between the platforms, the seal members each having a generally V-shaped cross-section so as to define upper and lower portions that extend longitudinally within the grooves, one of the upper and lower portions of each seal member being shorter in the longitudinal direction than the other and the seal member being inserted into the groove such that said shorter portion of the seal member engages the protrusion on the inner surface of the groove to retain the seal member in the groove.

6. The moving blade of claim 5 wherein each groove is adapted to receive an end portion of a seal member having a generally V-shaped cross-section.

7. A rotating blade row for a gas turbine, comprising:

a plurality of moving blades adapted to be adjacently arranged around a circumference disposed about a longitudinal axis of the gas turbine, each moving blade including a platform which has opposite sides that confront the corresponding platformns of adjacent moving blades, each platform including a forward flange portion and an aft flange portion, each flange portion defining two opposite corners spaced from corresponding corners of flange portions of adjacent moving blades;

seal pins inserted between adjacent platforms of the moving blades to prevent cooling air from leaking from lower parts of the moving blades between the adjacent platforms;

grooves formed at the four corners of the flange portions of each platform, each groove extending substantially in the longitudinal axis direction and in the circumferential direction; and a seal member inserted in each pair of adjacent grooves in the forward and aft flange portions of the moving blades so as to extend across gaps between the adjacent corners thereof to seal the gaps between the platforms, the seal members comprising seal plates, each seal plate having upper and lower portions joined to form a generally V-shaped cross-section of the seal plate, the seal plates being formed of an elastic material and adapted to urge the upper and lower portions against inner surfaces of the grooves for facilitating retaining the seal plates therein, one of the upper and lower portions of each seal plate being shorter in the longitudinal direction than the other portion and engaging protrusions formed on corresponding inner surfaces of the grooves to facilitate retaining the seal plates in the grooves.

* * * * *